US007134937B1

(12) United States Patent
Chen et al.

(10) Patent No.: US 7,134,937 B1
(45) Date of Patent: Nov. 14, 2006

(54) FOOD PRODUCT SLICER WITH KNIFE SHARPENER AND ASSOCIATED KNIFE GUARD

(75) Inventors: Shiyu Chen, Richmond Hill, GA (US); Shahram Shariff, Savannah, GA (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 11/311,062

(22) Filed: Dec. 19, 2005

(51) Int. Cl.
*B24B 49/00* (2006.01)

(52) U.S. Cl. ..... 451/11; 451/45; 451/420

(58) Field of Classification Search ..... 451/11, 451/45, 57, 65, 187, 193, 196, 198, 224, 451/229, 234, 293, 420; 83/174, 174.1
See application file for complete search history.

(56) References Cited

U.S. PATENT DOCUMENTS

| | | | | |
|---|---|---|---|---|
| 1,514,697 | A | | 11/1924 | Gury |
| 1,939,740 | A | | 12/1933 | Van Berkel |
| 2,141,055 | A | | 12/1938 | Van Berkel |
| 2,486,810 | A | | 11/1949 | Van Duyn |
| 2,698,638 | A | | 1/1955 | Foster |
| 2,970,624 | A | | 2/1961 | Lundell |
| 3,809,870 | A | | 5/1974 | Auble et al. |
| 3,986,304 | A | | 10/1976 | Shie, III |
| 4,019,286 | A | | 4/1977 | Spooner et al. |
| 4,090,403 | A | | 5/1978 | Tsukada et al. |
| 4,178,797 | A | | 12/1979 | Kozlowski, Jr. |
| 4,186,634 | A | | 2/1980 | Akczinski, Sr. |
| 4,246,818 | A | | 1/1981 | McGraw, Jr. |
| 4,351,029 | A | | 9/1982 | Maxey et al. |
| 4,497,143 | A | | 2/1985 | Mattei |
| 4,685,364 | A | | 8/1987 | Scheflow et al. |
| 4,817,480 | A | * | 4/1989 | Young ..... 83/174.1 |
| 4,962,581 | A | | 10/1990 | Rutigliano |
| 5,098,027 | A | | 3/1992 | McClure et al. |
| 5,101,704 | A | * | 4/1992 | Jones et al. ..... 83/174 |
| 5,144,773 | A | | 9/1992 | Flores et al. |
| 5,188,011 | A | | 2/1993 | Somal et al. |
| 5,209,025 | A | | 5/1993 | Martin et al. |
| 5,379,633 | A | | 1/1995 | Flisram et al. |
| 5,509,337 | A | | 4/1996 | Norman et al. |
| 5,591,072 | A | | 1/1997 | Tweed et al. |
| 5,609,512 | A | | 3/1997 | Holmes et al. |
| 5,626,065 | A | | 5/1997 | Cattini |
| 5,860,343 | A | | 1/1999 | Koch et al. |
| 6,123,449 | A | | 9/2000 | Sadek-Patt |
| 6,190,244 | B1 | * | 2/2001 | Jung ..... 451/293 |
| 6,591,157 | B1 | | 7/2003 | Vivirito et al. |
| 6,709,319 | B1 | | 3/2004 | Yan |
| 6,871,573 | B1 | | 3/2005 | Mang |
| 2001/0018317 | A1 | | 8/2001 | Yan |

* cited by examiner

*Primary Examiner*—Dung Van Nguyen

(57) ABSTRACT

A food product slicer with a rotatable slicer knife includes a knife sharpener and an associated knife guard assembly with a guard member positioned for protecting the edge of the knife when the sharpener is positioned in its standby, or non-sharpening state.

23 Claims, 12 Drawing Sheets

FOOD PRODUCT SLICER WITH KNIFE SHARPENER AND ASSOCIATED KNIFE GUARD

TECHNICAL FIELD

This application relates generally to food product slicers used for slicing bulk food products and, more specifically, to a food product slicer including a knife guard member in association with a knife sharpener.

BACKGROUND

Food product slicers having circular slicer knives are commonly used in restaurant and grocery businesses, among others. The use of slicer mounted knife sharpening assemblies to sharpen the peripheral edge of the slicer knife when necessary is also known. Protecting the edge of the knife along non-cutting zone regions of the knife is desirable as demonstrated by the common use of a ring guard disposed about a portion of the knife cutting edge to protect the edge of the knife. Because most ring guards are mounted in a manner to prevent removal by the end user in order to assure the knife protecting function, the ring guard cannot be positioned along the edge of the knife in the region where knife sharpening occurs, as doing so would interfere with knife sharpening. It would be desirable to provide a food product slicer that includes a knife guard member in association with the knife sharpener.

SUMMARY

In one aspect, a slicer for use in slicing a food product includes a slicer body and a slicer knife mounted to the slicer body for rotation and having a peripheral cutting edge defining a cutting plane. A guard assembly is connected to the slicer body. The guard assembly includes a knife guard member pivotable about a pivot axis between a cutting edge guarding position and a cutting edge sharpening position. The pivotable knife guard member includes a first portion to a first side of the pivot axis and a second portion to a second side of the pivot axis. In the cutting edge sharpening position, the first portion of the knife guard member moves to a first side of the cutting plane and the second portion of the knife guard member moves to a second side of the cutting plane. A sharpener assembly is mounted proximate the guard assembly and has a sharpening member that is movable between a sharpening position and a standby position. An actuator is operatively connected for enabling a user to move the sharpener member. The sharpener assembly interacts with the guard assembly such that, when the sharpening member is moved from the standby position to the sharpening position, the knife guard member moves from the cutting edge guarding position to the cutting edge sharpening position.

In another aspect, a method of protecting a peripheral cutting edge of a circular slicer knife and permitting sharpening of the cutting edge by a sharpener assembly is provided. The method includes the steps of: providing a knife guard member that is movable between a cutting edge guarding position and a cutting edge sharpening position; providing an interlock for preventing movement of the knife guard member from the cutting edge guarding position to the cutting edge sharpening position; when the removable sharpener assembly is mounted in an operating position on the slicer, the interlock is disabled at least during a sharpening operation of the sharpener assembly; when the removable sharpener assembly is removed from the slicer, the interlock continues to prevent movement of the knife guard member from the cutting edge guarding position to the cutting edge sharpening position.

In a further aspect, a slicer for use in slicing a food product includes a slicer body and a slicer knife mounted to the slicer body for rotation and having a peripheral cutting edge. A sharpener assembly is mounted in an operating position on the slicer body and has a sharpening member movable between a standby position and a sharpening position. The sharpener assembly is removable from the slicer body. A movable knife guard member has a cutting edge guarding position in which the knife guard member is positioned along a portion of the cutting edge proximate a sharpening location at which sharpening occurs, and a cutting edge sharpening position in which the knife guard member is spaced away from the sharpening location to permit the sharpening member to move into the sharpening position. An interlock is provided for maintaining the knife guard member in the cutting edge guard position when the sharpener assembly is removed from the slicer body.

DETAILED DESCRIPTION

Figure 1:
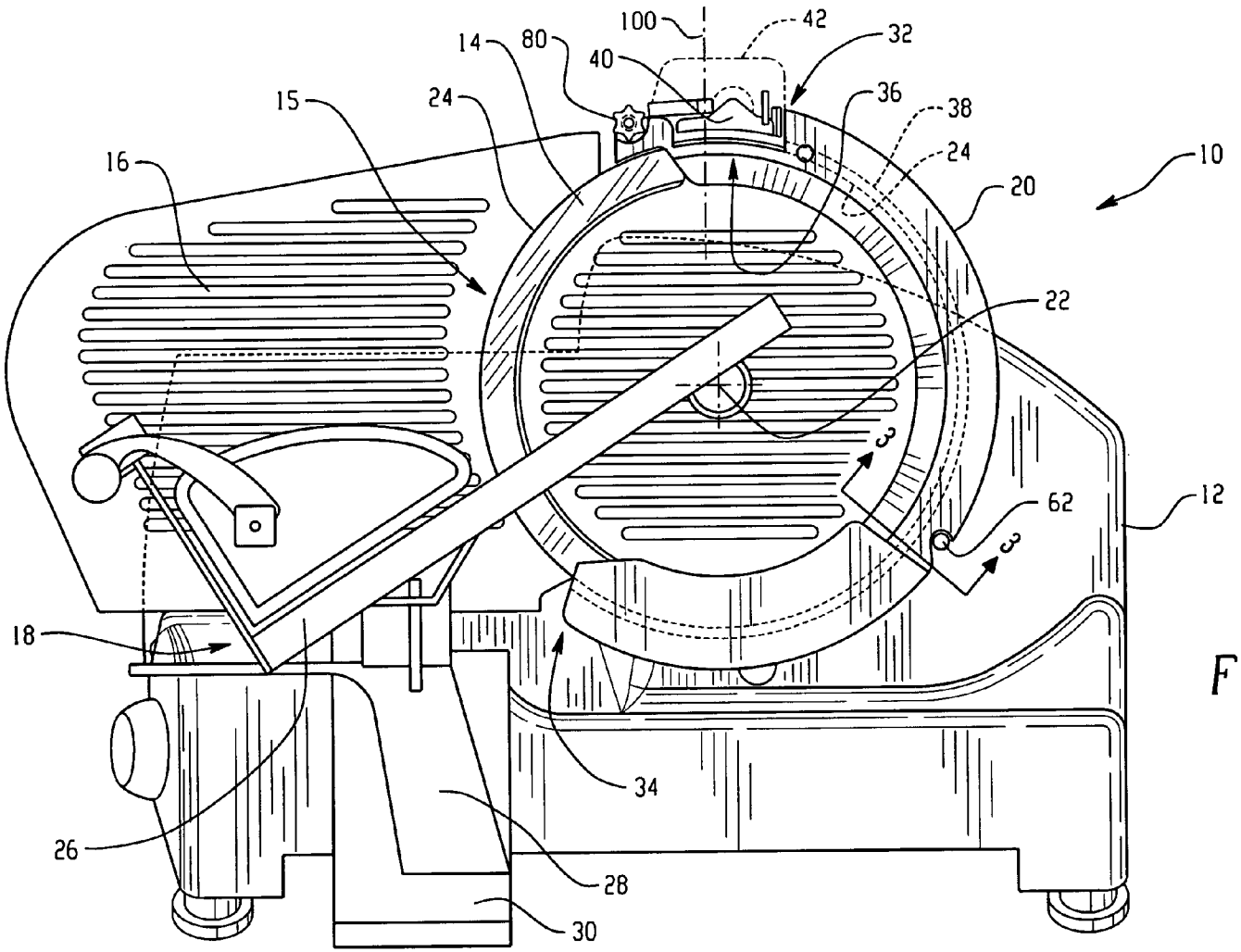
FIG. 1 is a side elevation of a food product slicer.

Referring to FIG. 1, a food slicing machine 10 includes housing 12 (often times also referred to as a base), circular slicing knife 14, gauge plate 16, product supporting carriage 18, and a cover plate 20. The circular slicing knife 14 is mounted to the housing for rotation about an axis 22 by a motor or other drive (not shown). A peripheral cutting edge 24 of the knife is exposed in a cutting region 15 of the knife that is proximate the gauge plate 16 (e.g., generally extending from approximately a seven o'clock position to an eleven o'clock position in the illustrated embodiment, with other variations possible). The gauge plate is movable transversely with respect to a plane defined by the peripheral edge 24 of the knife to control slice thickness, and can be located in a "zero" position wherein it is slightly raised above the cutting zone of the peripheral edge 24. The food product carriage 18 includes tray 26 mounted on support arm 28, which in turn may be pivotally mounted to a transport 30 that extends into the housing. The transport 30 is supported internal of the housing for linear, reciprocating movement back and forth past the slicer knife 14 in any suitable manner, variations of which are known in the art. Carriage movement may be implemented manually or automatically (e.g., as by a drive motor and belt system, hydraulics or other means). As food product is moved past the cutting edge of the knife in a slicing stroke, the food product on the tray 26 slides across the outwardly facing surface of the cover plate 20, which surface may be formed with raised ridges to improve slidability.

The illustrated cover plate 20 covers the peripheral cutting edge 24 of the slicer knife 14 from about a one o'clock position 32 to about a seven o'clock position 34. The peripheral cutting edge 24 is shown in shadow beneath the cover plate 20. In a twelve o'clock region 36 of the slicer knife 14, the cover plate diameter decreases to provide a space or opening at which the edge of knife can be sharpened. The cover plate 20 also extends over a ring guard 38 (only inner edge shown in shadow in FIG. 1) that is disposed about the peripheral cutting edge along at least a portion of the non-cutting zone of the circular slice knife, leaving a gap between ring guard and the peripheral cutting edge as shown. The ring guard may be fixed to the housing 12 in a stationary manner, or may be fixed to the housing to permit some movement for cleaning as described in U.S. Pat. No. 5,509,337. In either case, the ring guard is positioned to protect the cutting edge 24 of the slicing knife 14. In the illustrated embodiment, the ring guard 38 does not extend into the twelve o'clock zone 36 of the slicer knife, but such zone is provided with a knife guard member 40 that moves to permit sharpening by a sharpener assembly 42 (shown in dashed outline in FIG. 1). For example, knife guard member 40 may pivot about an axis 100 during sharpening. A small gap is provided between the knife guard member 40 and the peripheral edge 24 of the knife as shown.

In order to limit food product being thrown off the knife 14 and onto the ring guard 38 and/or knife guard member 40, a removable ring guard cover (not shown in FIG. 1) may be provided. Specifically, referring to FIG. 2, a perspective, exploded view showing ring guard 38, knife guard member 40 and a ring guard cover 50 is provided, with ring guard cover 50 in position spaced apart from the ring guard 38. The ring guard cover 50 includes a food catching wall 52 that is sized to fit within the gap between the peripheral cutting edge 24 of the knife and the ring guard. In the illustrated embodiment, the wall 52 extends circumferentially and forms a partial right circular cylinder, but variations are possible (e.g., complex curves and/or a wall with one or more flats). Notably, the wall 52 of ring guard cover 50 extends circumferentially so as to fit within the gap between the knife guard member 40 and the knife edge.

Figure 3:
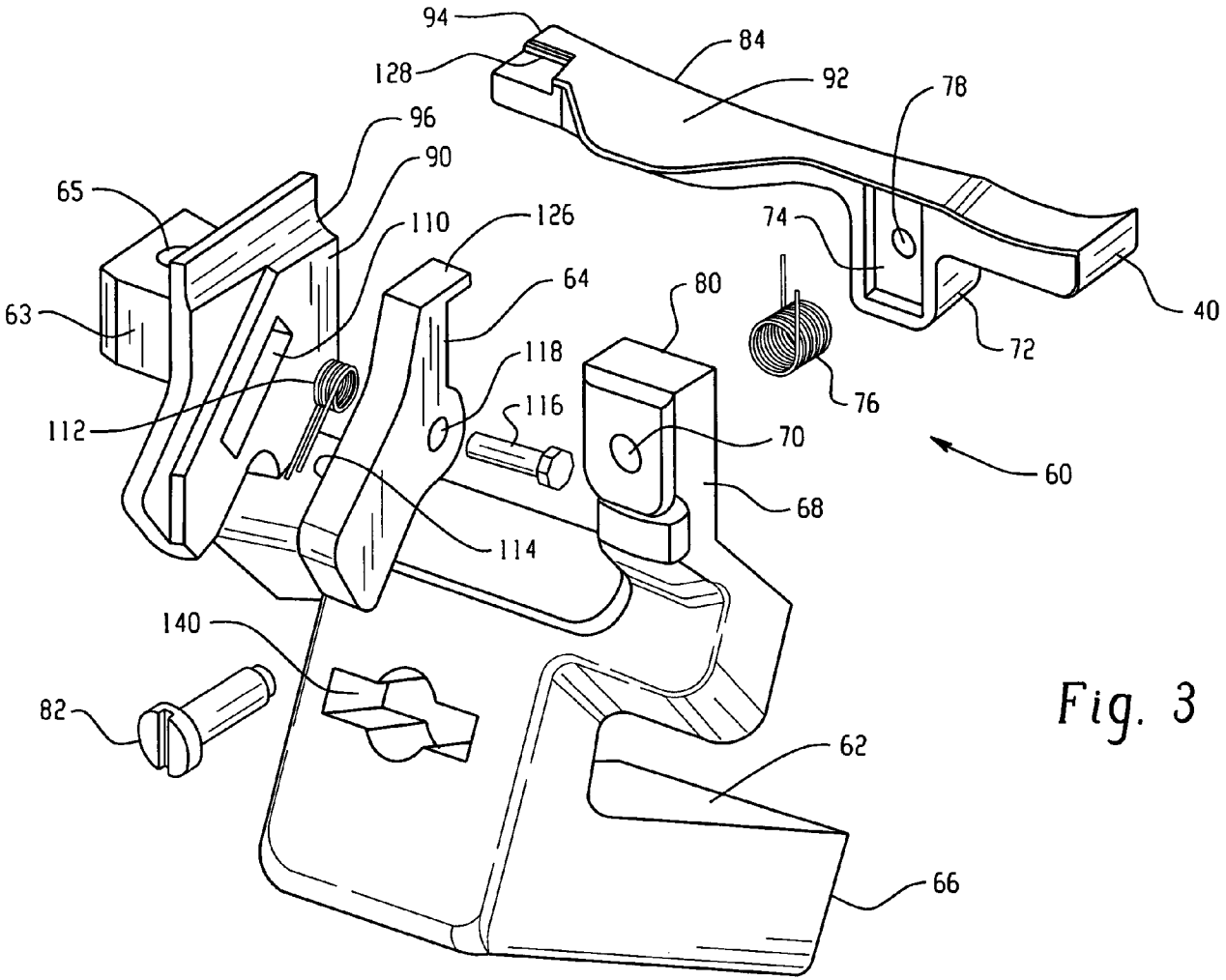
FIG. 3 is an exploded perspective of a knife guard assembly.

Referring now to FIG. 3, a perspective, exploded view of a knife guard assembly 60. Knife guard assembly 60 includes knife guard member 40, sharpener/guard mount arm 62, and an interlock member 64. Mount arm 62 may be fixed to the housing (or base) of the slicer, as for example by bolts extending upward through the housing and into threaded openings (not shown) in the bottom 66 of the mount arm and/or by an upper portion 63 that includes an additional mount hole 65 through which a fastener can pass for rigidly holding the mount arm 62 in place to the housing. Alternatively, mount arm 62 may be formed unitary with a casting or mold of the housing. Mount arm 62, in combination with housing (or base) 12, may be considered part of a slicer body as that term is used herein, but many variations on the configuration and make-up of a slicer body are possible.

The mount arm 62 includes a projecting guard mount 68 having a through opening 70. Knife guard member 40 includes a guard mount portion 72 with a spring receiving recess 74 formed therein to receive one end of torsion spring 76. The recess 74 has a threaded opening 78, which may or may not extend entirely through guard mount portion 72. Back side (or underside) 80 of guard mount arm 62 includes a similar spring receiving recess (not shown) for receiving the other end of torsion spring 76, with fastener 82 extending through opening 70, through torsion spring 76 and threading into opening 78 to connect the knife guard member 40 to the guard mount 68 in a manner that permits the knife guard member 40 to pivot about a pivot axis 100 (see assembled view of FIG. 4) that, in the illustrated embodiment, is slightly offset from, and generally parallel with a plane defined by the cutting edge 24 of the knife 14. The action of the torsion spring 76 (not seen in FIG. 4) biases the knife guard member into the cutting edge guarding position shown in FIG. 4, where the underside 84 of the knife guard member 40 is positioned proximate the knife edge.

Figure 4:
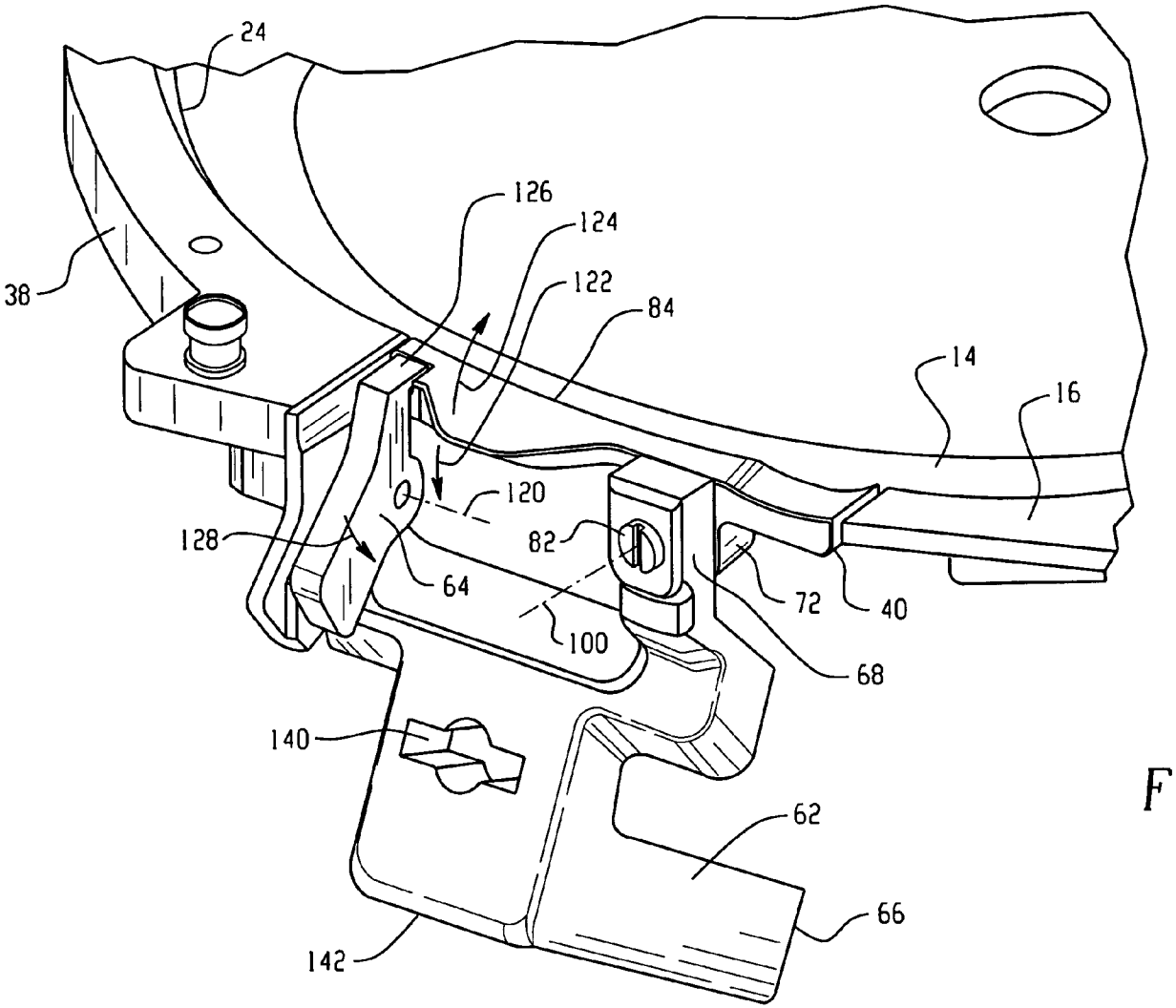
FIG. 4 is an assembled perspective of the assembly of FIG. 3.

Referring to both FIGS. 3 and 4, the mount arm 62 includes a projecting interlock mount portion 90 that is spaced apart from guard mount 68. Knife guard member 40 includes a portion 92 extending toward the interlock mount portion 90. The end 94 of portion 92 engages a seat 96 on the interlock mount portion 90 when the guard member 40 is in the cutting edge guarding position.

The interlock mount portion 90 includes an elongated opening 110 therein for receiving one end of torsion spring 112. The side 114 of interlock member 64 that lies adjacent the interlock mount portion 90 includes a corresponding elongated opening (not shown) for receiving the other end of torsion spring 112. Fastener 116 is disposed through opening 118, through the torsion spring 112 and into a threaded hole (not shown) at the inner side of elongated opening 110 to mount the interlock member in a manner that permits it to pivot about an axis 120 that may be substantially perpendicular to axis 100. The torsion spring 112 biases the interlock member into the locking position shown in FIG. 4, by which the knife guard member is held in the cutting edge guarding position. Specifically, the seat 96 prevents the knife guard member from pivoting about axis 100 in the direction of arrow 122 and the interlock member 64 prevents the knife guard member 40 from pivoting about axis 100 in the direction of arrow 124. In the illustrated embodiment, the interlock member 64 includes a projecting finger 126 sized for engaging a recessed seat 128 of the knife guard member 40. Interlock member 64 can be pivoted about axis 120 in the direction of arrow 128 so as to move to a non-locking position in which pivotal movement of the knife guard member 40 in the direction of arrow 124 is permitted.

Figure 5:
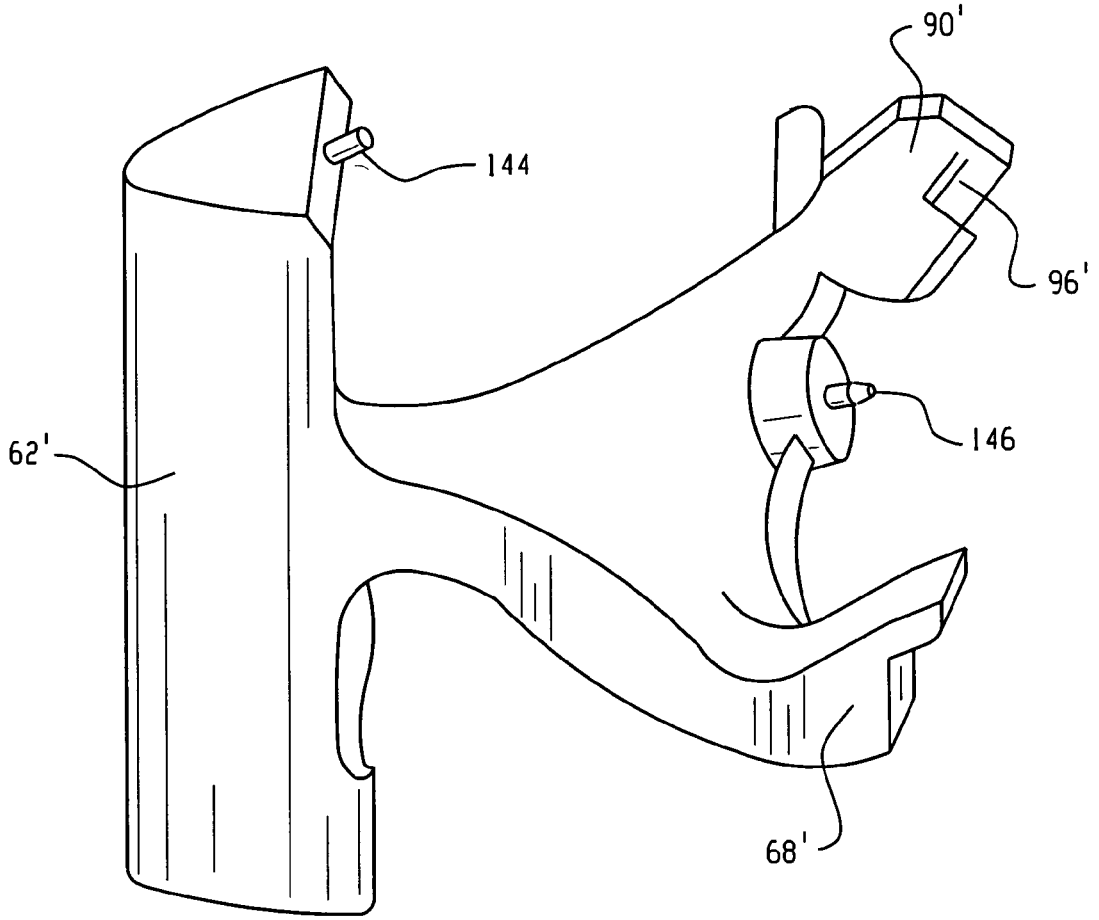
FIG. 5 is an alternative configuration for a mount arm.

In one implementation, movement of the interlock member 64 from its locking position to its non-locking position may be achieved via the action of a sharpening assembly. In this regard, mount arm 62 includes sharpener mount openings 140 and 142 by which a sharpener assembly can be mounted (in either a generally fixed or a removable manner) to the mount arm 62. In an alternative configuration show in part in FIG. 5, the mount arm 62' may include a pair of spaced apart upwardly projecting pins 144, 146 that are configured for insertion into openings of a removable sharpener assembly, with the sharpener assembly including a locking lever (such as that shown as member 92 in U.S. Pat. No. 5,591,072) for engaging a recessed portion of pin 146 to hold the sharpening assembly in place on the mount arm 62'. The guard mount portion 68', interlock mount portion 90' with seat 96' are also shown in FIG. 5.

Figure 6:
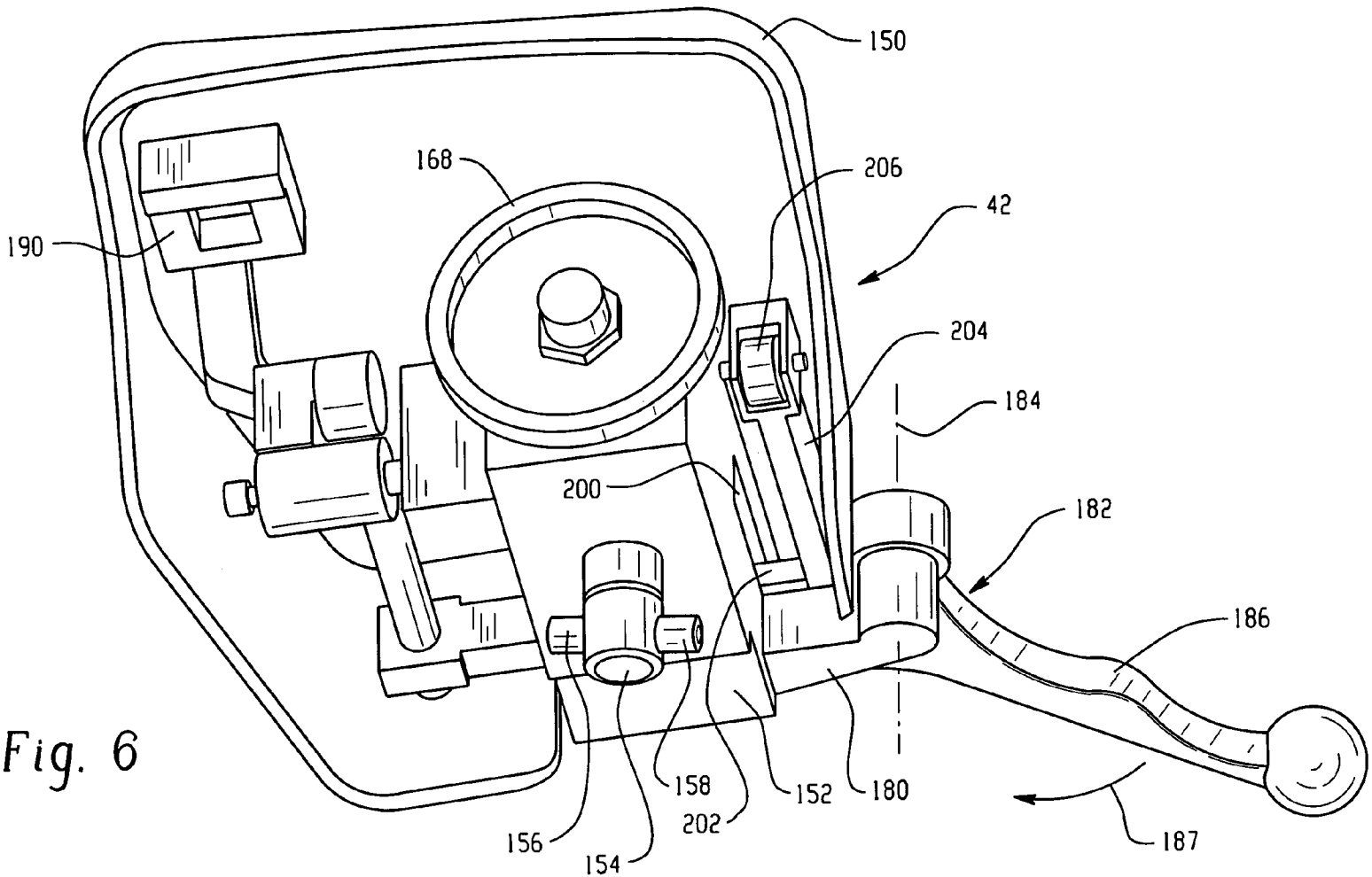
FIG. 6 is a bottom perspective of a knife sharpener assembly.
Figure 7:
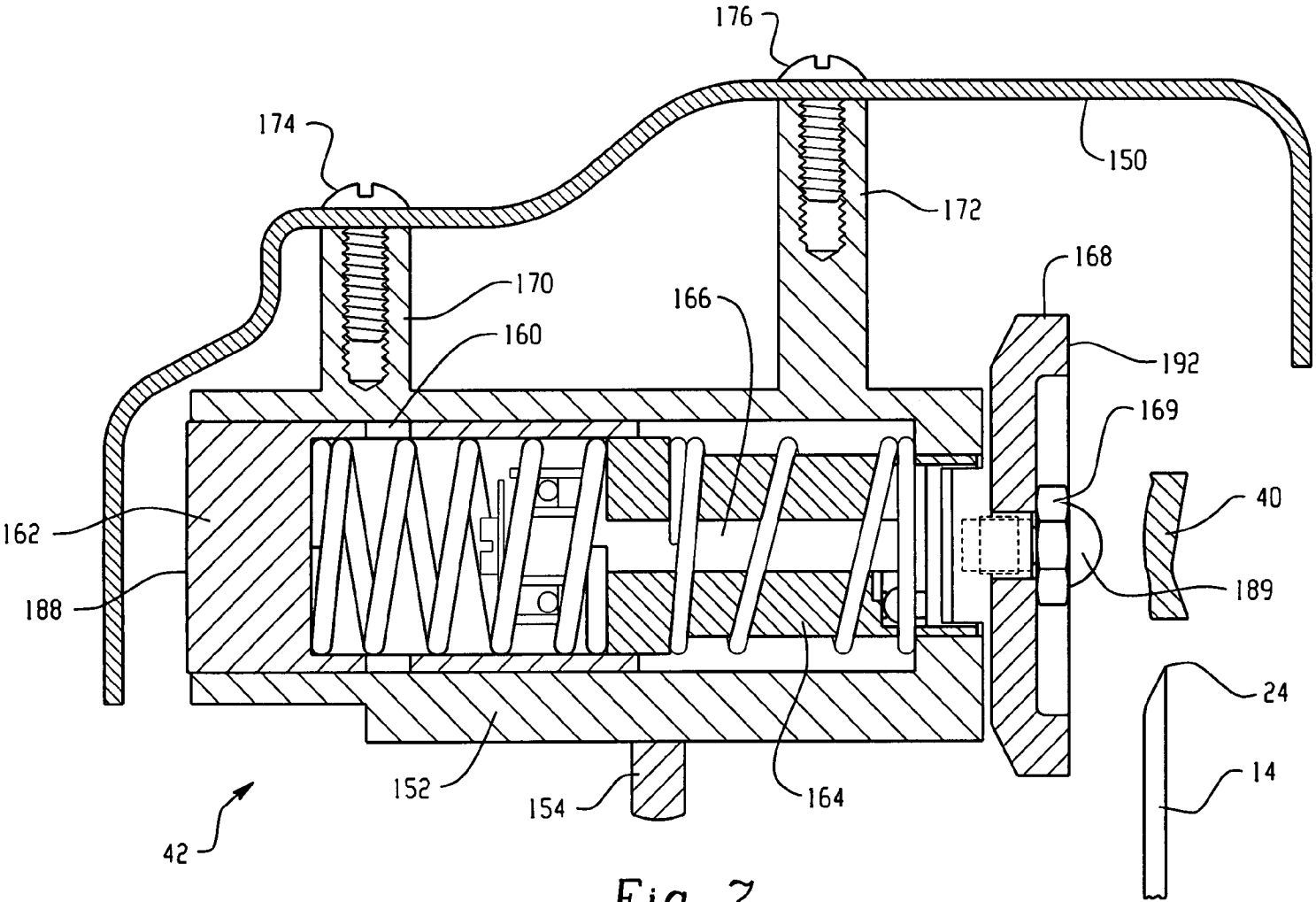
FIG. 7 is a partial cross-section of the knife sharpener assembly of FIG. 6.

Referring now to FIG. 6, a perspective view of the underside of a sharpener assembly 42 configured for mounting to the mount arm 62 of FIGS. 3 and 4 is shown. The sharpener assembly 42 includes a cover 150 that is coupled to a stationary block member 152. A mounting post 154 extends from the bottom of block member 152 and includes outwardly projecting pins 156, 158 for positioning in the side slots of mount opening 140 in mount arm 62 (see FIGS. 3 and 4). Referring to the partial cross-section of FIG. 7, the block member 152 includes a through passage or cavity 160 extending from end to end thereof and in which an actuator body 162 is slidably positioned for engaging a plunger assembly 164. The actuator body and plunger assembly operate substantially as described in U.S. Pat. No. 5,591,072 such that when actuator body 162 is moved toward the knife (e.g., to the right in FIG. 7), the springs of the plunger assembly 164 are compressed and the shaft 166 is moved toward the knife 14 so as to move the sharpening stone, in the form of wheel 168, toward the knife into a sharpening position in contact with the edge 24 of the knife 14. A stone retaining screw or bolt 169 is provided to hold the sharpening wheel 168 in place while at the same time allowing it to rotate. Alternatively, a screw may extend outward from within the block member 152 and member 169 may be a nut threaded onto the screw. As shown, the top of block member 152 includes mount posts 170, 172 for receiving fasteners 174, 176 to mount the cover 150 to the block member 152.

Referring again to FIG. 6, toward the rear portion (i.e., portion to be positioned furthest from the slicer knife upon sharpener installation) of the block member 152, a sidewardly extending lever mount 180 is provided and a lever 182 is pivotally mounted thereto for pivot about an axis 184. Lever 182 includes a handle portion 186 to one side of axis 184 and a cam portion (not shown in FIG. 6, but see 212 in FIG. 8) to the other side of axis 184. When the handle portion is gripped and rotated in the direction of arrow 187 of FIG. 6 (i.e., rearward and to the left in FIG. 6), the cam portion of the lever 182 engages the rear side 188 (see FIG. 7) of actuator body 162 to push the block member and move the sharpening stone from its standby position, which is the position shown in FIG. 7, to the sharpening position. As seen, when the stone 168 is moved toward the knife 14, the head 189 of the bolt 169 will contact the side of the knife guard member 40 prior to the working surface 192 of the stone 168 contacting the knife 14, which will pivot the knife guard member out of the cutting edge guarding position and into the cutting edge sharpening position. The sharpening assembly may also include a truing stone 190 (FIG. 6) that pivots to the right side of the knife (as viewed in FIG. 7) when the actuator body 162 is moved to the right to its fullest extent, as is generally shown and described in U.S. Pat. No. 5,591,072.

Referring again to FIG. 6, the block member 152 includes a side slot 200 from which a projecting arm 202 of the actuator body extends. The slot permits the projecting arm to move therealong as the actuator body is moved toward the knife. An interlock actuator 204 is provided at the end of the projecting arm and extends in a direction toward the knife 14 (e.g., to the right in FIG. 7). The interlock actuator 204 includes a rotatable wheel 206 positioned for engaging the interlock member as will now be described with respect to FIGS. 8–11.

Figure 8:
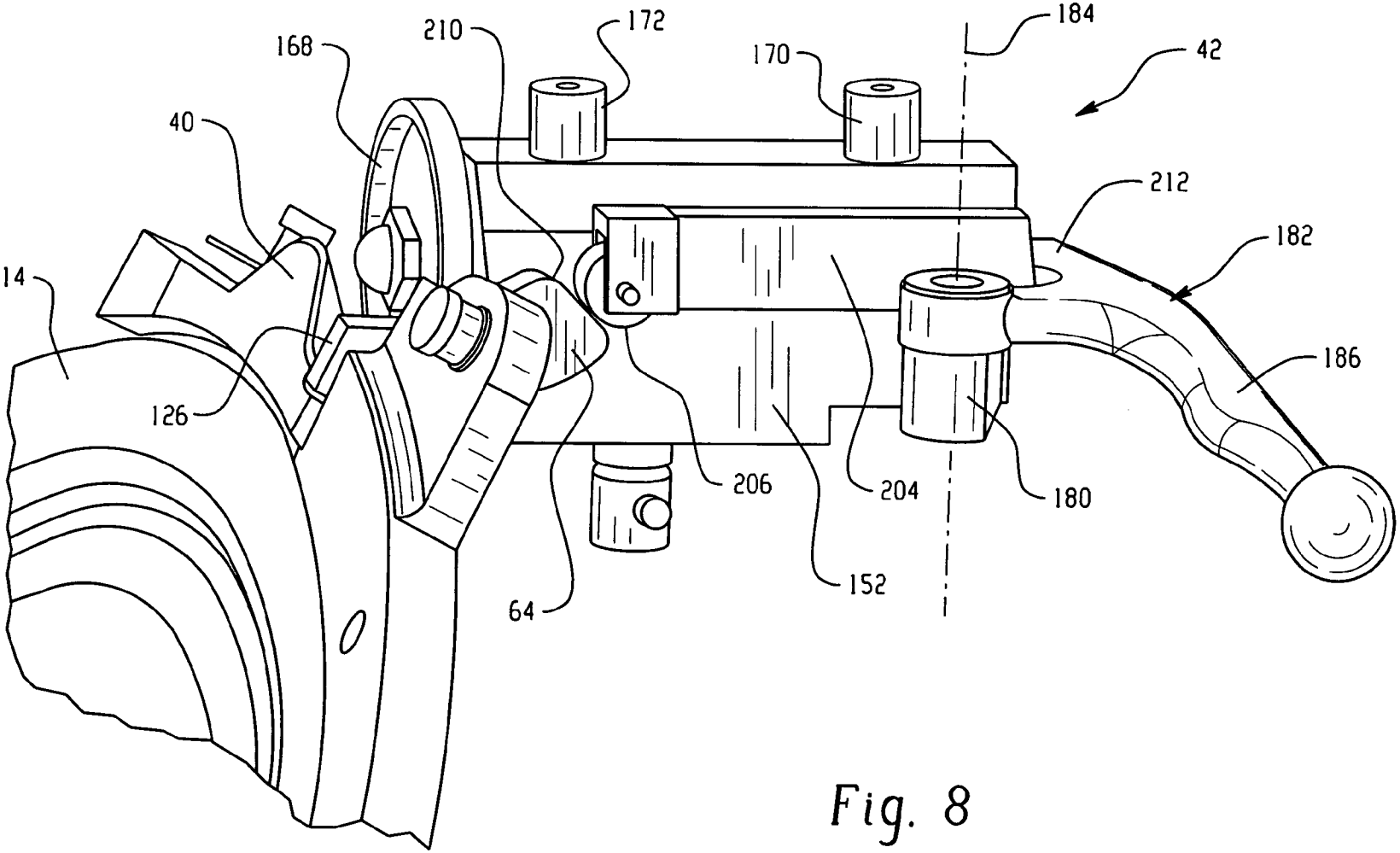
FIGS. 8–10 provide a series of perspective views showing interaction between the sharpener assembly and the knife guard assembly.
Figure 9:
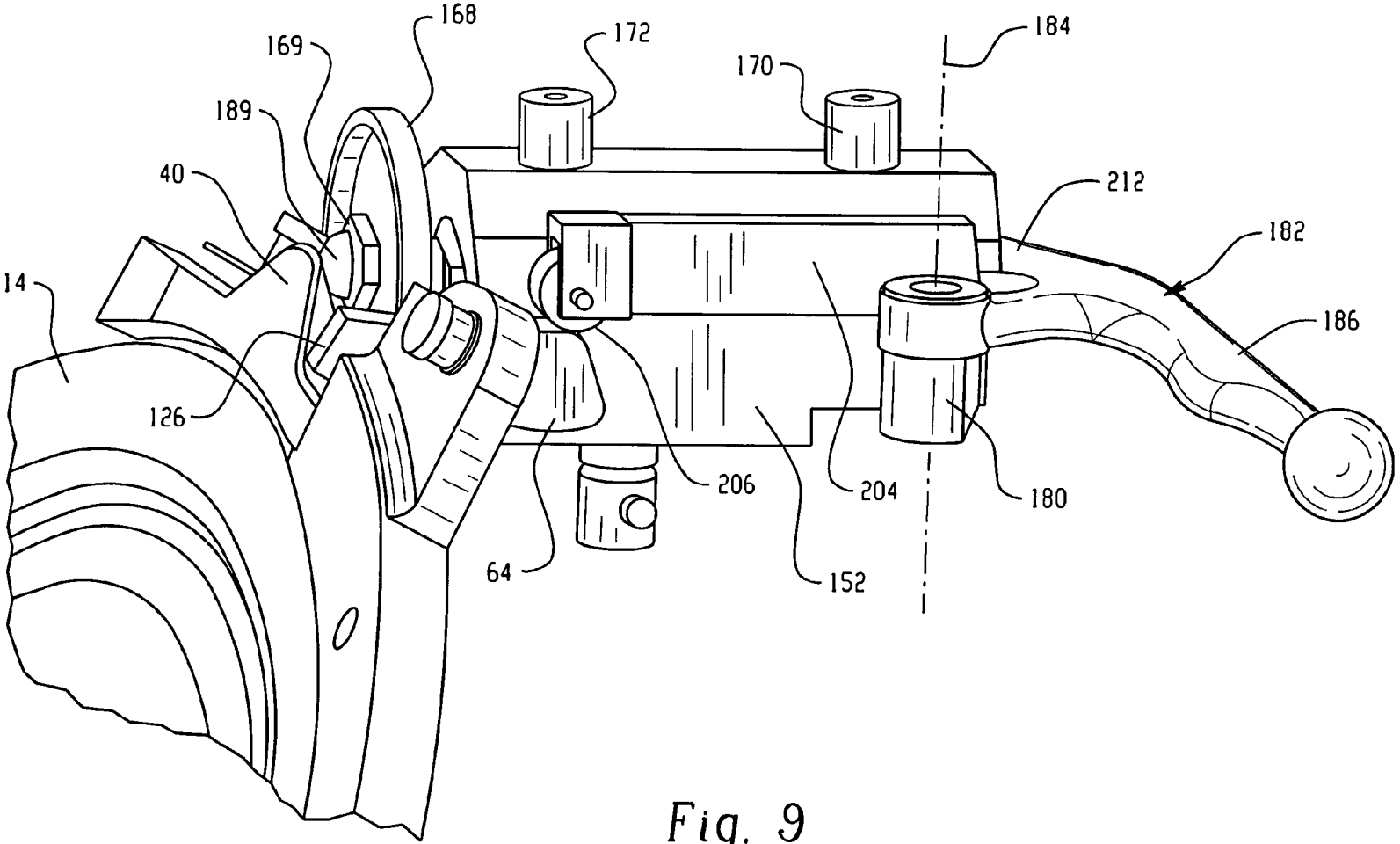
Figure 10:
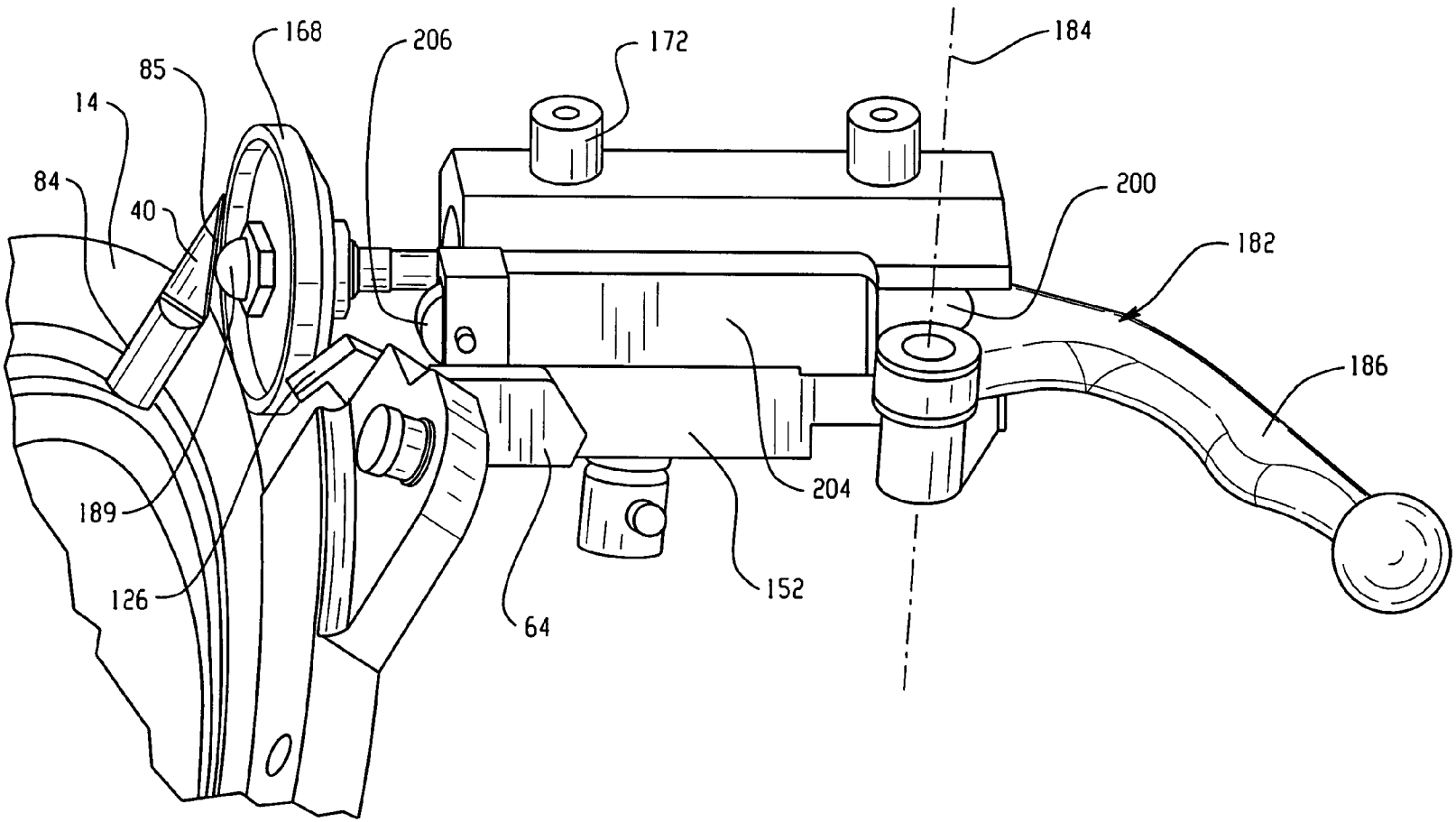
Figure 11:
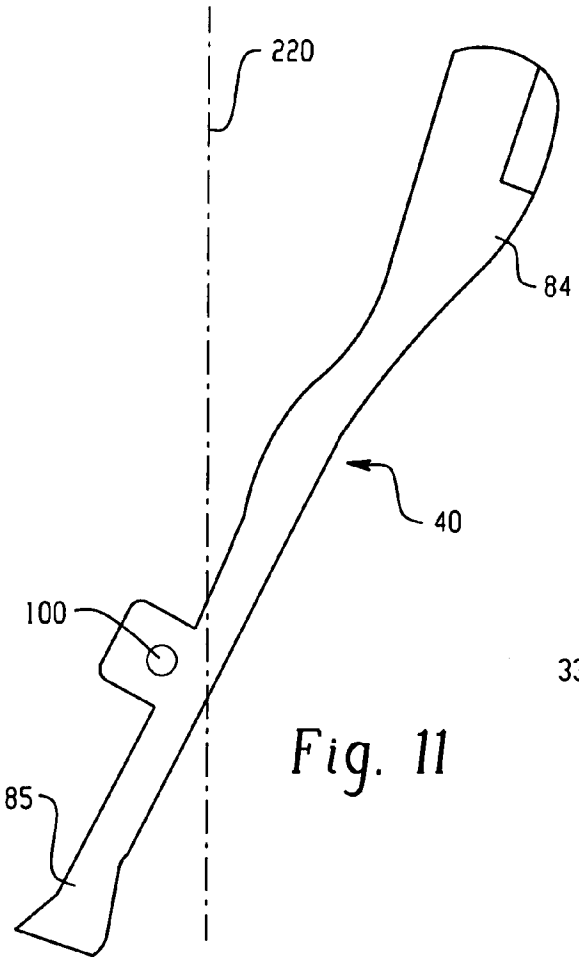
FIG. 11 is a schematic top view showing movement of a knife guard member relative to a knife edge plane.

Referring to FIGS. 8–11, the operation/movement of the truing stone 190 is not shown for sake of clarity. In FIG. 8, the sharpener assembly 42 (minus its housing) is shown in its mounted position on the slicer relative to knife 14 and knife guard member 40. The mount arm of the slicer is not shown. The sharpening wheel 168 is in its non-sharpening or standby position, spaced away from the knife. The interlock member 64 is shown in its locking position, with finger 126 holding the knife guard member 40 in its cutting edge guarding position. Interlock actuator 204 is located in its rearward position, with wheel 206 aligned for contacting a surface 210 of the interlock member 64. As seen in FIG. 9, as the sharpener actuating lever 182 is pivoted about axis 184 the actuator body 162 (not shown) and the interlock actuator 204 are moved toward the knife by the lever cam portion 212 of lever 182, and wheel 206 interacts with the interlock member 64 to pivot the interlock member into its non-locking position in which finger 126 is raised clear of the knife guard member 40. The bias of the interlock member 64 maintains it in the cutting edge guarding position. As shown, sharpening wheel 168 is also moved toward the knife 14 and the head portion 189 of the bolt or nut 169 is positioned adjacent a portion of the knife guard member 40 that is offset from the pivot axis of the knife guard member. As seen in FIG. 10, as the lever 182 is rotated further, the head portion 189 pivots the knife guard member 40 out of its cutting edge guarding position and into its cutting edge sharpening position, and the sharpening wheel 168 contacts the edge of the knife 14 for sharpening. When the knife guard member 40 pivots, portion 84 moves to one side of the plane defined by the cutting edge of the knife (to allow sharpening wheel 168 to contact one side of the knife) and portion 85 moves to the other side of the plane defined by the cutting edge of the knife (to allow the truing stone to be brought into contact with the other side of the knife). FIG. 11 shows a partial view of this orientation, with line 220 indicating the plane of the knife cutting edge. Referring again to FIG. 10, the interlock actuator 204 maintains the interlock member 64 in its non-locking position. When the lever 182 is released, due to the bias in the system, the components move back toward their original positions shown in FIG. 8 and the sharpened knife is ready for use, with the knife guard member 40 returned to its cutting edge guarding position.

Thus, the illustrated knife guard member and sharpener assembly provide an arrangement in which the knife guard member is normally maintained in its cutting edge guarding position, but is moved to its cutting edge sharpening position when the sharpener is actuated for sharpening the knife. The interlock member is normally maintained in its locking position until initiation of a sharpening operation. In the case of a removable sharpener, the bias of the interlock member also maintains the interlock member in the locking position when the sharpener is removed from the slicer.

Figure 12:
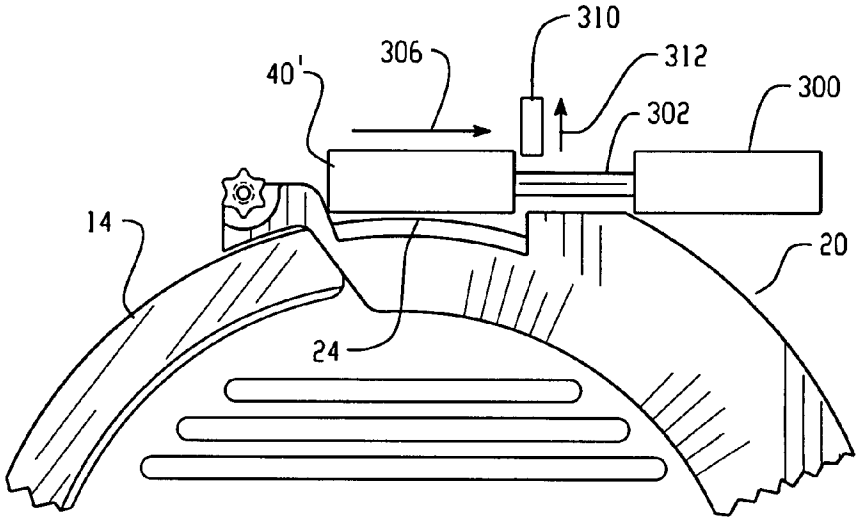
FIG. 12 is an alternate embodiment of a knife guard arrangement.

Referring now to the partial side elevation of FIG. 12, an alternate embodiment of a knife guard arrangement is provided in which the knife guard 40' is in the form of a shutter that moves linearly under the control of a powered actuator such as solenoid 300 that is linked to the guard member 40' by a rod 302. Solenoid 300 is biased to the left to place the guard member in the illustrated cutting edge guarding position. Upon energization of the solenoid 300, the rod 302 is pulled (to the right) causing the knife guard member 42' to likewise move in the direction of arrow 306 (to the right) into a cutting edge sharpening position that permits the sharpener assembly to contact the edge 24 of the knife 14. The arrangement includes a movable interlock member 310 that is biased into the illustrated locking position to prevent movement of the guard member 40'. Operation of the sharpener assembly may move the interlock member upward, as indicated by arrow 312, into a non-locking position that is clear of the guard member. In one embodiment, the interlock member 310 may interact with the sharpener assembly in much the same way as the interlock member 64 of FIGS. 3 and 4, with the finger 126 moving into and out of the path of the guard member 40'.

Figure 13:
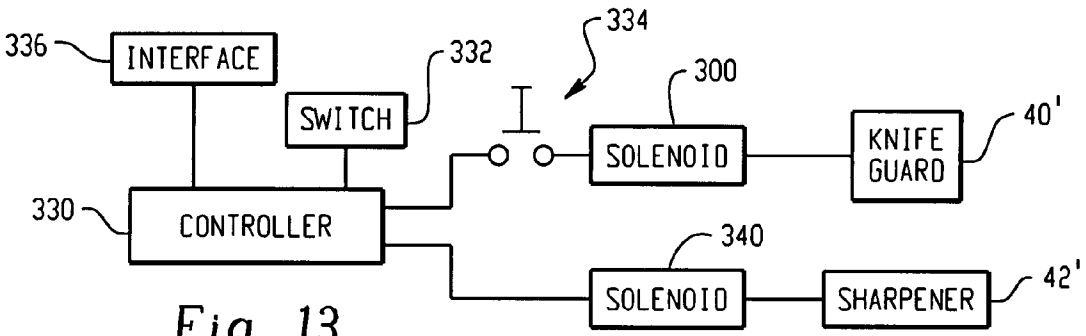
FIG. 13 is a block diagram of an embodiment of a slicer with the knife guard arrangement of FIG. 12.
Figure 14:
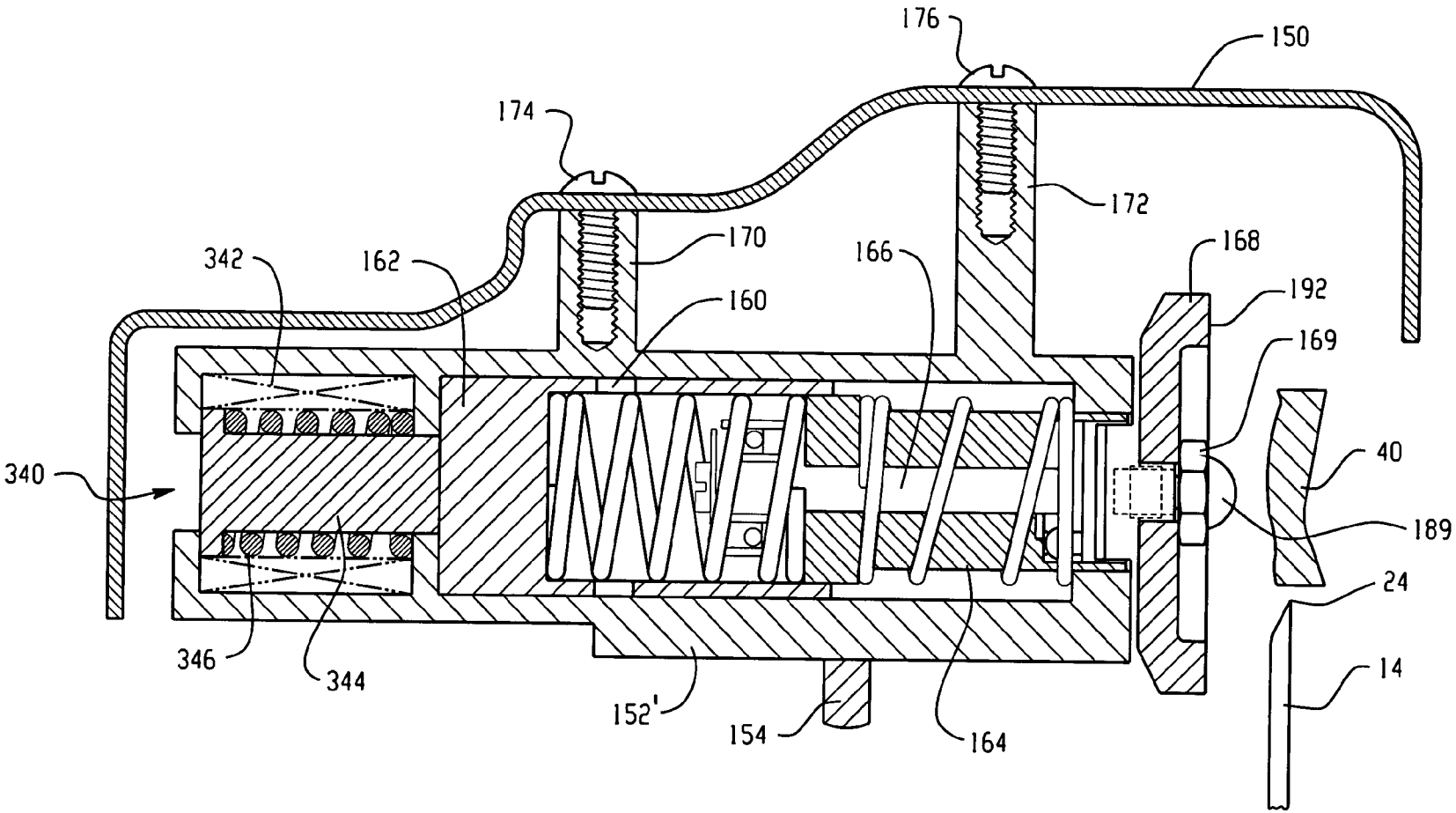
FIG. 14 is a partial cross-section view of a sharpener assembly for use with the slicer of FIG. 13.

Referring now to FIG. 13, a block diagram of a slicer is shown, with knife guard member 40' and solenoid 300. A controller 330 may be operatively connected to effect energization of the solenoid 300 when an input switch 332 on the slicer is actuated by a user. An electrical interlock may also be provided, for example, by a contact switch 334 that is closed when the sharpener assembly is installed on the slicer and that is opened when the sharpener assembly is removed so as to prevent energization of the solenoid 300. A user interface 336 is also shown. The user interface may display operator messages. A sharpener assembly 42' may be operated by a powered actuator such as solenoid 340 (for example, when the switch 332 is actuated). In this regard, reference is made to the partial cross-section of FIG. 14, where the sharpener assembly 42' is shown as an extended version of the sharpener assembly 42, with the solenoid positioned 340 at the end of an elongated block member 152'. The solenoid 340 includes coil 342 that, when energized, moves plunger 344 to the right for moving the actuator body 162. A spring 346 biases the plunger 344 into the illustrated position.

In operation, when switch 332 is actuated, the controller 330 may cause the interface 336 to display a message such as "Please Wait—Sharpening In Progress." The controller energizes the solenoids 300 and 340. When the sharpener assembly moves, it contacts the interlock member 310 to move it to the non-locking position. The knife guard member 40' then moves to the cutting edge sharpening position to allow sharpening. Upon completion of sharpening (e.g., after a certain time period) the solenoids 300 and 340 are de-energized. It is recognized that, depending upon the implementation, the solenoids 300 and 340 may not necessarily be energized and de-energized in synchronization with each other.

Figure 2:
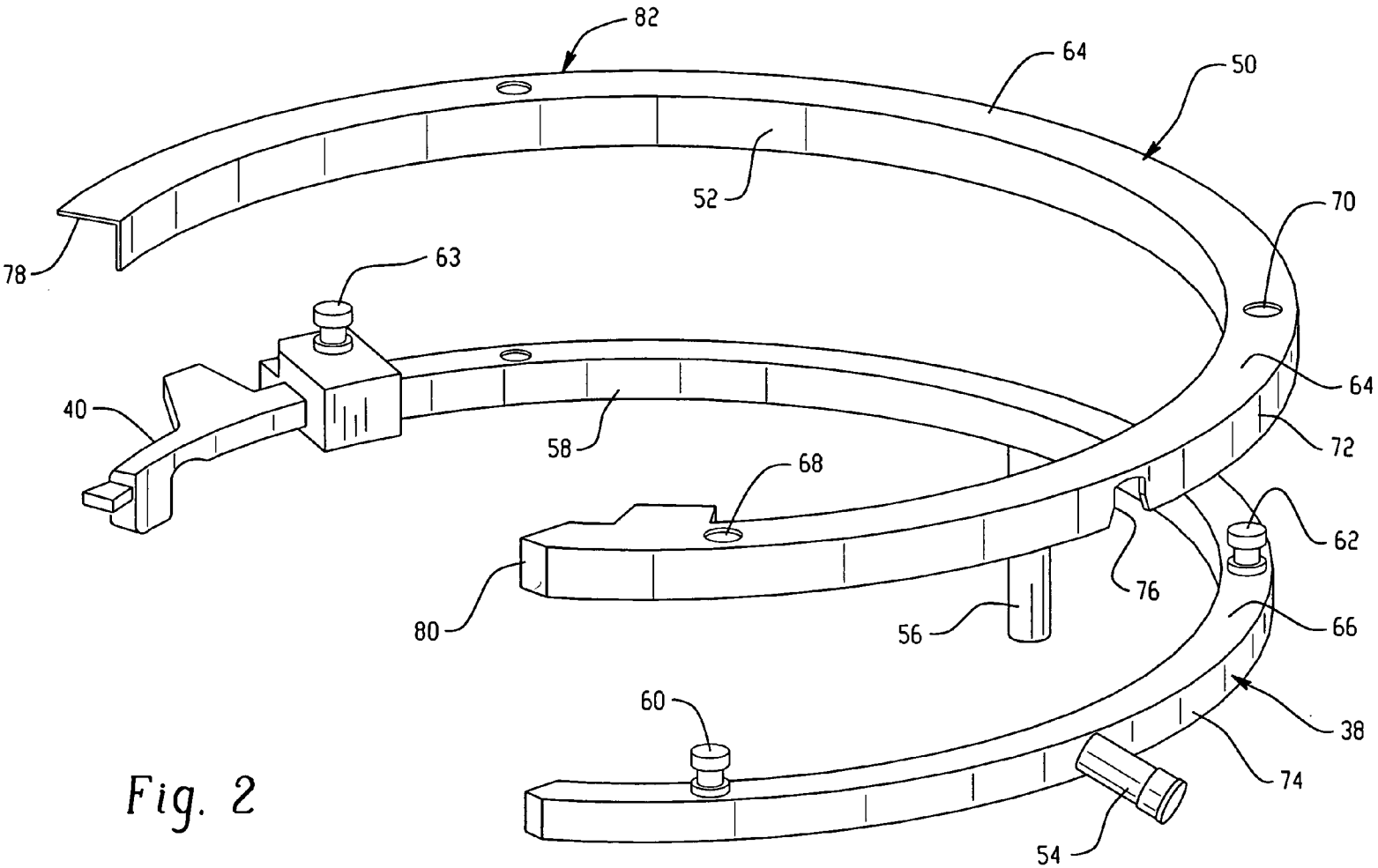
FIG. 2 is a partial, exploded perspective of a ring guard and ring guard cover.

In an alternative embodiment, solenoid 300 may be a rotary solenoid that is connected for rotating the knife guard member 40 of FIGS. 3 and 4. Switch 332 may be eliminated, particularly where interface 336 takes the form of a touch-sensitive display that can be used to initiate automated sharpening.

Where the slicer includes the ring guard cover 50 shown in FIG. 2, the cover plate 20 and ring guard cover 50 will be removed prior to initiating a sharpening operation such that wall 52 of the ring guard cover is removed from the gap between the knife guard member and the knife edge.

It is to be clearly understood that the above description is intended by way of illustration and example only, is not intended to be taken by way of limitation, and that other changes and modifications are possible.

What is claimed is:

1. A slicer for use in slicing a food product, the slicer comprising:

a slicer body;

a slicer knife mounted for rotation relative to the slicer body, the knife having a peripheral cutting edge defining a cutting plane;

a guard assembly connected to the slicer body, the guard assembly including a knife guard member pivotable about a pivot axis between a cutting edge guarding position and a cutting edge sharpening position, the pivotable knife guard member includes a first portion to a first side of the pivot axis and a second portion to a second side of the pivot axis, when in the cutting edge sharpening position the first portion of the knife guard member moves to a first side of the cutting plane and the second portion of the knife guard member moves to a second side of the cutting plane; and a sharpener assembly mounted proximate the guard assembly and having a sharpening member that is movable between a sharpening position and a standby position, an actuator operatively connected for enabling a user to move the sharpener member;

the sharpener assembly interacts with the guard assembly such that when the sharpening member is moved from the standby position to the sharpening position, the knife guard member moves from the cutting edge guarding position to the cutting edge sharpening position.

2. The slicer of claim 1 wherein the sharpener assembly is removable from the slicer and the slicer further includes an interlock member that holds the knife guard member in the cutting edge guarding position when the sharpener assembly is removed from the slicer.

3. The slicer of claim 2, wherein the interlock member disengages the knife guard member when the sharpener assembly is mounted on the slicer.

4. The slicer of claim 3, wherein the interlock member is biased to engage the knife guard member.

5. The slicer of claim 4, wherein the interlock member pivots about a pivot axis.

6. The slicer of claim 1, wherein the sharpening member includes a sharpening wheel carried by a shaft.

7. The slicer of claim 1 wherein the sharpener assembly further includes a second sharpening member movable between a sharpening position and a standby position.

8. The slicer of claim 1, wherein the sharpening member is biased toward the standby position.

9. A slicer for use in slicing a food product, the slicer comprising:

a slicer body;

a slicer knife mounted for rotation relative to the slicer body, the slicer knife having a peripheral cutting edge;

a sharpener assembly mounted in an operating position on the slicer body and having a sharpening member movable between a standby position and a sharpening position, the sharpener assembly removable from the slicer body;

a movable knife guard member having a cutting edge guarding position in which the knife guard member is positioned along a portion of the cutting edge proximate a sharpening location at which sharpening occurs, and a cutting edge sharpening position in which the knife guard member is spaced away from the sharpening location to permit the sharpening member to move into the sharpening position;

an interlock for maintaining the knife guard member in the cutting edge guarding position when the sharpener assembly is removed from the slicer body.

10. The slicer of claim 9 wherein the interlock comprises an interlock member having a locking position in which the interlock member engages the knife guard member and holds it in the cutting edge guarding position, the interlock member movable to a non-locking position in which the interlock member does not prevent movement of the knife guard member out of the cutting edge guarding position.

11. The slicer of claim 10 wherein, when the sharpener assembly is removed from the slicer body, the interlock member is biased to stay in the locking position absent application of an external force to the interlock member.

12. The slicer of claim 11 wherein the interlock member is biased into the locking position when the sharpener assembly is mounted in the operating position, when the sharpener assembly is actuated for sharpening, a portion of the sharpener assembly engages the interlock member to move the interlock member to the non-locking position.

13. The slicer of claim 10, wherein the interlock member pivots about a pivot axis.

14. The slicer of claim 13, wherein the knife guard member pivots about a pivot axis that is substantially perpendicular to the pivot axis of the interlock member.

15. The slicer of claim 9 wherein the interlock comprises a powered actuator operatively connected for moving the knife guard member, when the sharpener assembly is removed from the slicer body operation of the powered actuator is disabled.

16. The slicer of claim 15 wherein, when the knife sharpening assembly is mounted in the operating position, operation of the powered actuator moves the knife guard member from the cutting edge guarding position to the cutting edge sharpening position.

17. The slicer of claim 16 wherein a powered actuator is associated with the sharpening member for moving the sharpening member from the standby position to the sharpening position.

18. The slicer of claim 9 wherein the sharpener assembly includes a powered actuator for moving the sharpening member from the standby position to the sharpening position.

19. The slicer of claim 15 wherein the interlock further comprises an interlock member having a locking position in which the interlock member blocks movement of the knife guard member out of the cutting edge guarding position, the interlock member movable to a non-locking position in which the interlock member permits movement of the knife guard member out of the cutting edge guarding position.

20. A method of protecting a peripheral cutting edge of a circular slicer knife of a slicer, and permitting sharpening of the cutting edge by a removable sharpener assembly, the method comprising:

providing a knife guard member that is movable between a cutting edge guarding position and a cutting edge sharpening position;

providing an interlock for preventing movement of the knife guard member from the cutting edge guarding position to the cutting edge sharpening position;

when the removable sharpener assembly is mounted in an operating position on the slicer, the interlock is disabled at least during a sharpening operation of the sharpener assembly;

when the removable sharpener assembly is removed from the slicer, the interlock continues to prevent movement of the knife guard member from the cutting edge guarding position to the cutting edge sharpening position.

21. The method of claim 20 wherein the interlock comprises a powered actuator for moving the knife guard member, when the sharpener assembly is removed from the slicer, operation of the powered actuator is disabled.

22. The method of claim 21 wherein the interlock further comprises a movable interlock member that is biased into a locking position that prevents movement of the knife guard member from the cutting edge guarding position to the cutting edge sharpening position, the interlock member movable to a non-locking position that permits movement of the knife guard member from the cutting edge guarding position to the cutting edge sharpening position.

23. The method of claim 20 wherein the interlock comprises a movable interlock member that is biased into a locking position that prevents movement of the knife guard member from the cutting edge guarding position to the cutting edge sharpening position, the interlock member movable to a non-locking position that permits movement of the knife guard member from the cutting edge guarding position to the cutting edge sharpening position, when the sharpener assembly is mounted in the operating position on the slicer and is actuated for sharpening, a portion of the sharpener assembly engages the interlock member to move the interlock member to the non-locking position.

* * * * *